US006938849B2

(12) United States Patent
Badiali

(10) Patent No.: US 6,938,849 B2
(45) Date of Patent: Sep. 6, 2005

(54) DEVICE AND PROCESS FOR REMOVING THE DEFECTIVE END PORTIONS FROM YARN ON A PACKAGE FED TO AN AUTOMATIC WINDER

(75) Inventor: Roberto Badiali, Pordenone (IT)

(73) Assignee: Savio Macchine Tessili S.p.A., Pordenone (IT)

( * ) Notice: Subject to any disclaimer, the term of this patent is extended or adjusted under 35 U.S.C. 154(b) by 215 days.

(21) Appl. No.: 10/291,928

(22) Filed: Nov. 11, 2002

(65) Prior Publication Data

US 2003/0094083 A1 May 22, 2003

(30) Foreign Application Priority Data

Nov. 16, 2001 (IT) ..... MI2001A2421

(51) Int. Cl.[7] ..... B65H 67/02; B65H 67/08

(52) U.S. Cl. ..... 242/475.5; 242/475.4; 242/475.6; 242/474.1; 242/476.1

(58) Field of Search ..... 242/474.1, 474.2, 242/475.4, 475.5, 475.6, 476.1

(56) References Cited

U.S. PATENT DOCUMENTS

| | | | | |
|---|---|---|---|---|
| 5,058,816 A | | 10/1991 | Schreiber | |
| 5,078,329 A | * | 1/1992 | Grecksch et al. | 242/474.1 |
| 5,499,772 A | * | 3/1996 | Maeda et al. | 242/417.2 |
| 5,553,799 A | * | 9/1996 | Todo | 242/128 |
| 5,676,329 A | * | 10/1997 | Bertoli et al. | 242/413.9 |
| 5,680,751 A | * | 10/1997 | Premi | 57/22 |
| 5,829,706 A | * | 11/1998 | Schatton et al. | 242/457.4 |
| 5,862,660 A | | 1/1999 | Haasen et al. | |
| 5,871,163 A | * | 2/1999 | Bertoli et al. | 242/150 M |
| 5,871,168 A | * | 2/1999 | Ruskens et al. | 242/474.2 |
| 6,123,283 A | * | 9/2000 | Hayashi et al. | 242/419.4 |
| 6,270,033 B1 | * | 8/2001 | Haasen et al. | 242/474.1 |
| 6,533,211 B2 | * | 3/2003 | Kargel et al. | 242/475.5 |

FOREIGN PATENT DOCUMENTS

| | | |
|---|---|---|
| EP | 0 787 674 | 8/1997 |
| EP | 1 875 478 | 11/1998 |
| EP | 1 151 951 | 11/2001 |

OTHER PUBLICATIONS

EP Search Report.
Patent Abstracts of Japan vol. 1997, No. 03, Mar. 31, 1997 & JP 08 310730.

* cited by examiner

*Primary Examiner*—Emmanuel Marcelo
*Assistant Examiner*—E Langdon
(74) *Attorney, Agent, or Firm*—Hedman & Costigan, P.C.

(57) ABSTRACT

Device and process for the automatic elimination of the defective start and end portions from packages of yarn fed to the units of an automatic winder using the same members thereof for reattaching the ends eliminating said portion from them, by suction with the suction nozzles for capturing and moving the ends, for a predetermined length and then joining its ends according to the normal reattachment of the yarn.

10 Claims, 4 Drawing Sheets

12
14
13
10
2
β
11
6
α
20
16'
5
9
7
4
2
16
3
1
15

12
14
13
10
24
2
β
23
11
6
21
22
5
α
20
16'
9
7
4
2
16
3
1
15

12
14
13
10
33
2
β
32
11
21
6
34
5
α
16'
31
9
7
30
4
16
3
1
15

DEVICE AND PROCESS FOR REMOVING THE DEFECTIVE END PORTIONS FROM YARN ON A PACKAGE FED TO AN AUTOMATIC WINDER

BACKGROUND OF THE INVENTION

The present invention refers to a device and a process for unwinding yarn from cops or spools for feeding to machines for preparing yarn, and in particular to automatic winding machines, removing its defective end portions.

In order to highlight both the technical problems tackled and solved by the present invention and its characteristics and advantages with respect to the prior art, it shall be described with reference to its fundamental points in the winding process in an automatic winder.

As is known, automatic winders consist of a plurality of winding stations or units lined up along the front of the machine equipped with common service apparatus to feed them with full spools and to discharge them as empty tubes to be recycled.

BRIEF SUMMARY OF THE INVENTION

The winding unit is illustrated in its essential components in FIG. 1, leaving out those which are not directly involved in the joining of the yarn. The feeding spool or cop 1 is unwound taking away the yarn 2. The yarn 2 passes from the uncoiling group which comprises members for guiding the yarn 3, the sensor or detector of the presence of yarn 4 and the yarn tightener 5, in general consisting of a pair of interfacing platelets which press the yarn being unwound between them with regulated and controlled pressure. Along the path there is also the yarn-splicer 6, to which the ends of yarn to be joined are carried by suction nozzles 9 and 10, which shall be described in greater detail hereafter, when there are interruptions in the yarn due to it breaking or due to interruptions by the yarn clearer 11 which is immediately downstream of the yarn-splicer. The wound yarn is collected in the package 12, which is actuated into rotation by the roller 13, upon which it rests supported with the package-holding arm 14. The actuation with the roller 13 is carried out at a predetermined speed which is independent from the size of the package in formation. It draws the yarn 2, unwinding it at a high speed of rotation from the spool 1 which, on the other hand, is kept still on a positioning pin 15, for example based upon a transportation platelet.

The suction nozzle 9 sucking from the side of the spool is susceptible to the angular movement $\alpha$ which first carries its suction nozzle to capturing the end of the yarn 2 from the unwind group, and then being lifted from it with the rotation $\alpha$, holding the end of the spool side and taking it to the yarn-splicer 6. The suction nozzle 10 sucking from the side of the package, on the other hand, is susceptible to the angular movement $\beta$ which takes its suction nozzle first to capturing the end of the yarn 2 from the package 12 and then lowering with the rotation $\beta$ to take the end on the package side to the yarn-splicer 6. Such a yarn-splicer then proceeds to operate the joining after having received the two ends, having cut them to size, sucking in the waste in the suction nozzles 9 and 10, and having lined them up correctly. The yarn-splicer, after having restored its continuity, releases the yarn to go back to its winding configuration from spool to package.

The winding process, in its basic lines, consists of unwinding feed yarn and of removing its end portions which are defective either by mechanical consistency or by size. In its passage from the spool 1 to the package 12, the yarn 2 is controlled by the yarn clearer 11 which detects its dimensional defects, both in terms of cross-section and in terms of length. The yarn clearer 11 commands the cutting of the yarn each time the detected size of the yarn 2 is not within the acceptable range for the yarn, which is preset at the start of each specific winding treatment according to a calibration which is more or less strict depending upon the desired dimensional homogeneity of the yarn being wound. The yarn-cutting member is incorporated in the same yarn clearer 11, or else it is separate but directly controlled by it. In FIG. 1, the cutting group is shown as an example separate as scissors 7, immediately above the sensor 4 of the yarn and under the yarn tightener 5.

In more sophisticated models of winders the frequency of the defects is checked directly by the yarn-clearer to detect the so-called moire defects, or by the command member for the reattachment to check that the winding unit is not working with low yield on a spool with too many defects which it is better to throw away immediately and replace with another new spool. Generally, the spool fed and the package produced contain a measured and controlled length of yarn, currently indicated as metering, but depending upon the defects contained in the yarn there is not a precise relationship between the two meterings, i.e. between the number of spools fed and the package produced by them, although each package is generally produced with tens of spools. The winding unit is, indeed, equipped with the so-called "meter-counter" which measures the length of the yarn under treatment both unwinding from the spool 1 and winding up onto the package 12.

After the yarn 2 has been broken or cut by the yarn clearer 11, the sensor or detector of the yarn 4 indicates the absence of yarn to the control unit 16 of the winding station. The control unit 16 comprises and in turn commands a unit 16' which contains the command and control program for the yarn reattachment process, through the connections shown with a broken line according to a standard sequence of successive operations or steps essentially consisting of:

a) capturing the end of the yarn from the side of the package 12 with the suction nozzle 10, commanding the counter-rotation of the actuation, roller 13 of the package so that it gives up a length of yarn corresponding to its standard, b) capturing the end of the yarn from the side of the spool 1 with the suction nozzle 9, c) delivery with the suction nozzle 9 of the spool-side end to the yarn-splicer device 6 in a specific position dedicated to receiving it, d) delivery with the suction nozzle 10 of the package-side end to the yarn-splicer device 6 in a specific position dedicated to receiving it, e) cutting to size, suction of waste, alignment and joining of the two ends of the yarn 2 to re-establish its continuity from the spool 1 to the package 12.

f) release of the joined yarn 2 and reinserting it in its path to return into its normal operating winding configuration.

g) restarting the winding upon the signal of a positive presence of the yarn by the yarn clearer 11 and by the sensor of the yarn 4.

In the search and capture operations of the two ends, before they are joined a certain standard length of yarn is sucked in and eliminated from the two sides which contain the defective portion which has engaged with the yarn clearer 11 causing its cutting intervention or else it snaps off.

The yarn 2 wound on the package 12 is thus removed of its defective portions which have been detected by the yarn clearer 11 as being outside the allowed calibration range which was set at the start of the treatment of the stock of yarn.

The present invention is described here with reference to its main application to treatment in winders for yarn wound on spools, given as a non-limiting example, since the device and process according to the present invention can have advantageous application in controlling the high-speed unwinding of yarn wound in another package, for example in so-called package/package-winding.

A technical problem which has a substantial influence upon the quality of wound yarn comes from the portions of yarn which have a widespread irregularity with frequent defects which cannot be detected by the normally controlled member 11 or which cannot be eliminated with the normal yarn reattachment cycles, unless at the expense of the winding yield and with too narrow calibrations. The problem of long irregularities in yarn is, for example, considered in U.S. Pat. No. 5,862,660.

Generally speaking, such widespread imperfections are at the two far ends of the package of yarn being fed in the form of a spool or another winding package. Anomalous portions of yarn thus lie upon the outer surface of the feed package and are the ones which are first put to work, hereafter said portions being referred to as start portions; other anomalous portions of yarn, on the other hand, lie in contact with the surface of the tube, and hereafter shall be referred to as end portions, still with reference to the feed package. In patent EP 787.674, the elimination of such end portions of yarn is considered.

In the case in which the yarn of the feed spool comes from a normal ring spinning, those portions of the tube and on the outer layer correspond with the start and end transitional steps of the spool itself, for starting and doffing respectively, and are in the order of one meter or slightly more. The normal standards of joining in the winding process are thus able to eliminate such portions of yarn produced in the transitional step and special provisions are not necessary.

On the other hand, when we are dealing with a special ring spinning, like that of flake yarns, i.e. from non-conventional spinning or from special feeds, the length of the start and end defective portions can greatly exceed the end lengths taken away in joining and thus it is necessary to modify the interventions. As an example, the ring yarn coming from a start portion of the sliver package obtained from the flyer machine can often have a long portion with widespread defectiveness.

The removal of such layers is not therefore possible since the yarn-clearer is not capable of detecting these widespread defects, or else it would require excessively raising the sensitivity level of the yarn-clearer—i.e. narrowing its allowed defectiveness range—with the consequent reduction in the yield of the normal winding operations.

In other cases, for example in package/package-winding of packages coming from dying baths, shown as an example in FIGS. 4 and 5, the layer of yarn in contact with the perforated tube from which the dying bath is introduced under pressure, permeating through the thickness of the winding with flow from inside to outside the dimensions of the defective portions are of a different order of size. The end layer, the one in contact with the perforated tube, can have a heavier colour tone, because a higher amount of pigment deposits in it, it can even be more squashed, due to the pressure of the outer layers wound on it. The start layer, the one on the outside of the dying package, can have a slightly different colour tone, due to the effect of the drying process, and can have defects even by deterioration, stains or abrasions in the manipulation or transportation between the various treatment steps. The problem of the elimination of the most inner portion of the dying package is considered in patent application EP 875.478.

FIG. 1 illustrates the technical problem of the winding station. As already stated, such anomalous long portions, with light and widespread defectiveness even for hundreds of meters, cannot be eliminated with the normal standard reattachment cycles of the automatic winders, both for a too narrow calibration of the yarn-clearer which would have to be adopted and for a large number of sequential repetitions of the interventions, with the consequent reduction in the winding yield to an unacceptable level.

The present invention refers to a process and a device for removing the defective start and end portions from yarn on a feed package affected by the aforementioned widespread defectiveness. The purpose of the present invention is to realise a fast and simplified process for eliminating the start and end portions of yarn wound on feed packages replacing the normal reattachment process as a consequence of the breaking or cutting of the yarn which takes place in normal winding of the yarn wound in a package.

The present invention, in its most general form of the process for eliminating the end portions of feed yarn, is defined in claim 1.

The characteristics and advantages of the process and device for eliminating the end portions of feed yarn according to the present invention shall become clearer from the description of some of its typical embodiments, given as an example and not for limiting purposes, illustrated hereafter with reference to the figures.

DETAILED DESCRIPTION OF THE INVENTION

Figure 1:
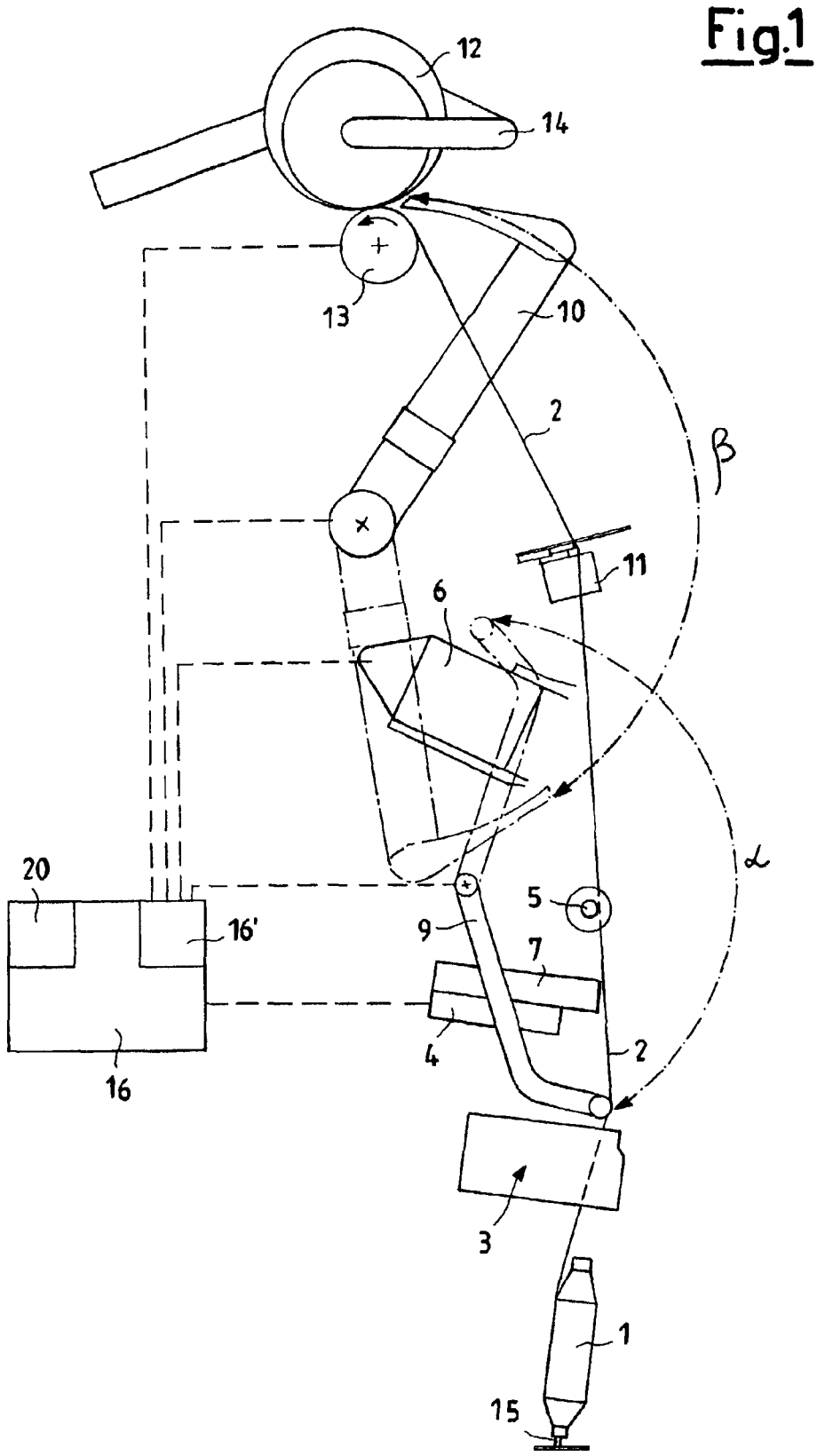
FIG. 1 is a perspective view of the winding machine's essential components.
Figure 2:
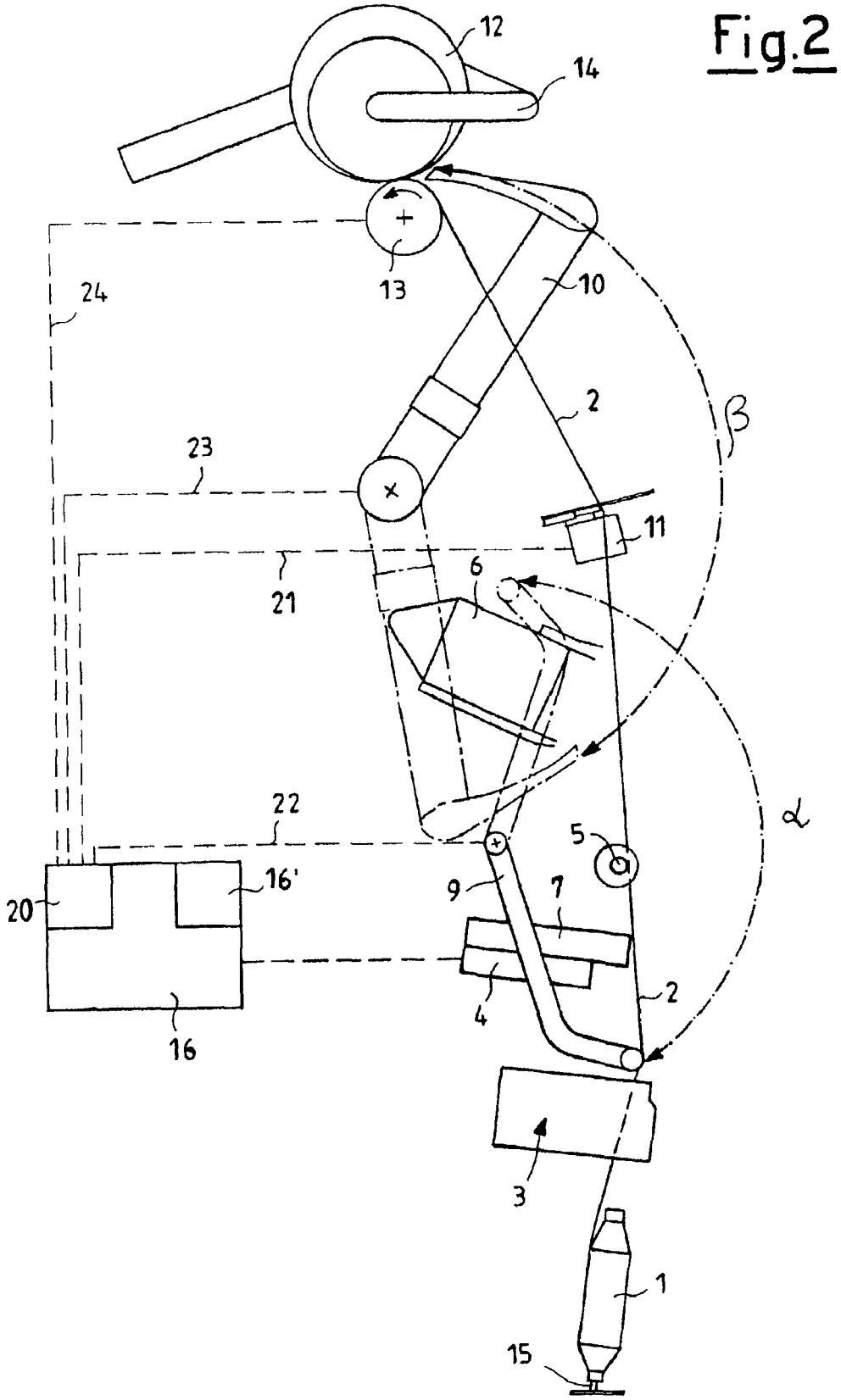
FIG. 2 is a perspective view of the winding machine's in the removal process.
Figure 3:
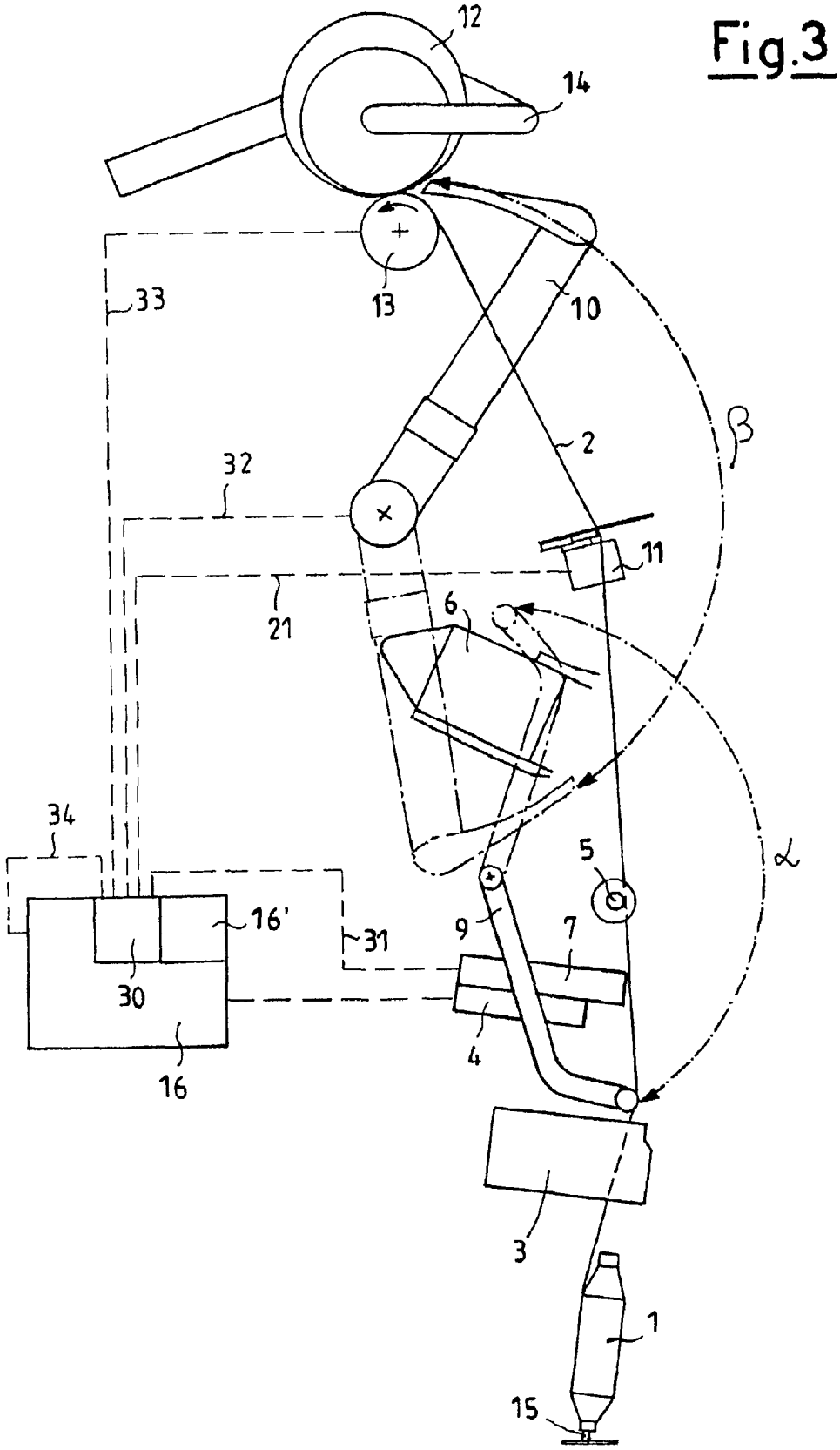
FIG. 3 is a perspective view of the winding machine's in the removal process.
Figure 4:
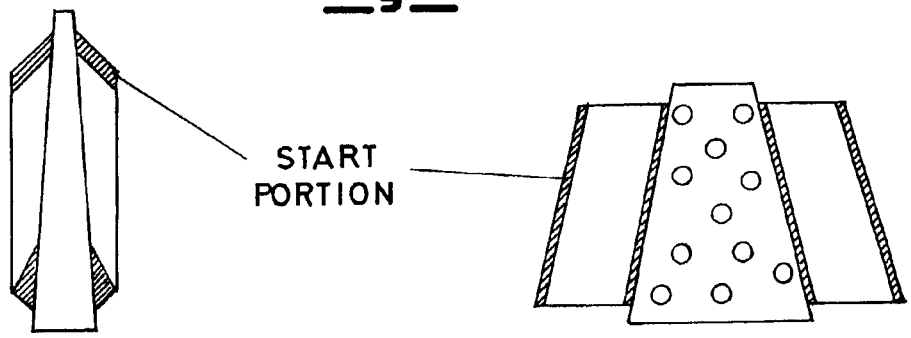
FIG. 4 is a perspective view of the winding machine's package spinning spool and dying package.
Figure 5:
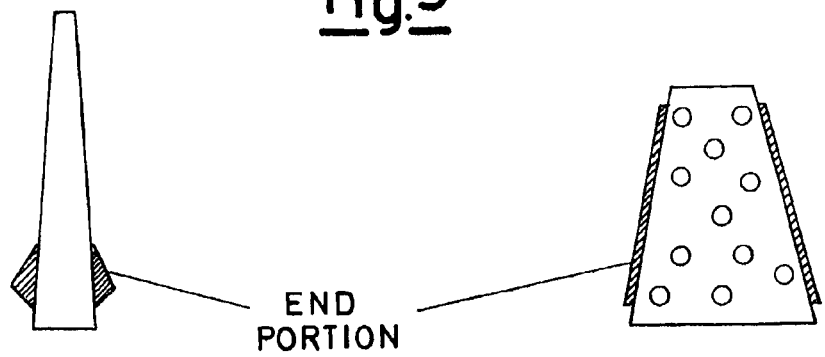
FIG. 5 is a perspective view of the winding machine's package spinning spool and dying package.
Figure 6:
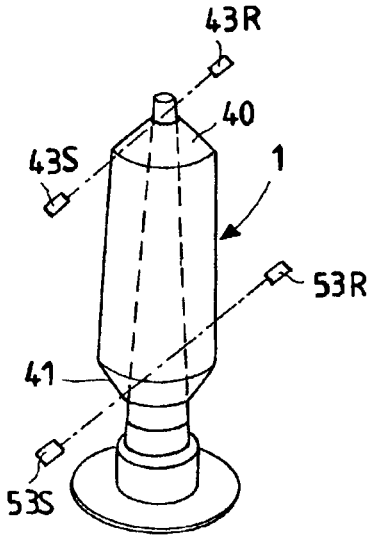
FIG. 6 is a perspective view of the winding machine's device for detecting yarn defects.
Figure 7:
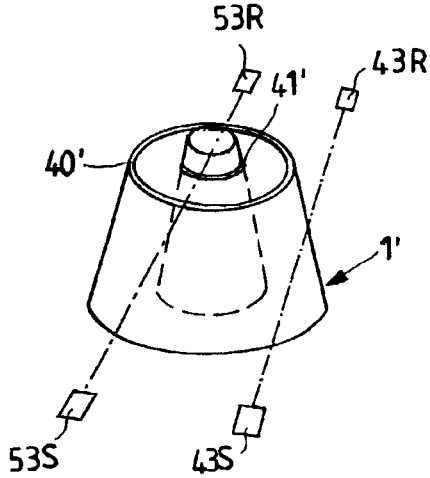
FIG. 7 is a perspective view of the winding machine's device for detecting yarn defects.

In the figures both the technical problem and the solutions proposed with the present invention are illustrated. FIG. 1 illustrates a configuration of the winding station and of the path of the yarn from the feeding in a spool to collection on a package. In FIGS. 2 and 3 the example embodiments of the removal process according to the invention are shown. FIGS. 4 and 5 show, for packages both on a spinning spool and on a dying package, the typical positions of the defective or potentially defective portions of yarn, the elimination of which must be foreseen to safeguard the quality of the wound yarn. FIGS. 6 and 7 show devices for detecting the entry in work of the portions deemed to be defective, for which removal must be carried out.

The present invention realises the removal of the defective end portions from the yarn of each spool or package of yarn fed to the winding unit. For such a purpose during the unwinding of the start portion and, at the end of the metering carried out on such a package, of its end portion, the line of connection with its unit 16' is disconnected or deactivated, still carried out by the control unit 16 of the winding station, according to FIG. 2, wherein the control unit controls and commands the standardised reattachment process of the yarn being wound. In such a step, on the other hand, a unit 20, still included in the control unit 16, is connected which in turn contains the command and control program for the treatment of the yarn and oversees the elimination of the end portions, according to a preset length thereof depending upon the characteristics and the origin of the yarn in operation. The length of the start and end portions to be removed from each package is derived based upon the specific experience and observation of the yarn being treated as well as the consideration of its destination.

During the intervention of the unit 20 the yarn clearer 11, or at least its yarn cutting member, is deactivated with the connection 21, since the portions to be eliminated do not have to be shortened any further. The start and end portions are eliminated by sucking them in, unwinding them from the underlying feed spool and from the overlying wound package respectively, commanding and using the suction capturing nozzles for the ends autonomously, independently and outside of the reattachment cycle. For such a purpose, the controls 22 and 23 are respectively connected to the suction nozzle from the side of the spool 1 and of the package 12 for the autonomous command of such suction nozzles to move close to and explore the surfaces of such two packages of yarn with analogous methods to those of standard reattachment, for a specifically preset time, depending upon the length of yarn to be eliminated for each part of the stock of yarn being treated. With the connection 24, the counter-rotation of its actuation roller 13 is simultaneously commanded so that the package gives off the length of yarn necessary for the removal of its end portion.

At the end of such removal operations, the unit 20 commands the same operations from c) to g) of the normal reattachment process, or else gives up their management to the unit 16' which is made to function again by the unit 16, and, however, it disconnects the unit 20. In other words, the different operations a') and b') of the command process of the unit 20 differ from the operations a) and b) of the standard process of the unit 16' substantially for the actuation times and for eliminated lengths of yarn, barring the simultaneous deactivation of the yarn clearer 11.

It is worth noting that such operations of removing yarn from its defective end portions is carried out with the same members which carry out the normal reattachment cycle, with suitably sized intervention times and simply excluding the action of the yarn clearer 11.

As for the device which takes care of the reattachment of the ends through the capturing and joining thereof, which—according to the present invention—also allows the elimination of the defective end portions of the feed packages to be realised, it has the characteristic that the different members which operate in its operating cycle, like the suction nozzles, cutting members and the yarn-splicer, are commanded and capable of being actuated independently from each other and are not rigidly interconnected—apart from the software-type controls—and are managed by the control unit 16 of the winding station with alternative and different procedures according to the needs to be satisfied each time. The present invention, in its most general embodiment as a device, is defined in claim 6.

According to a preferred embodiment of the process according to the invention, according to FIG. 3, the process is carried out with the following methods contained in a different control and command unit 30, still included in the control unit 16, which contains the command and control program for the elimination of the end portions, according to their preset length depending upon the characteristics and the origin of the yarn in operation, still using the members available for yarn reattachment cycle. The sequence of successive operations or steps of such a preferential process essentially comprises the following operations, still with the yarn clearer 11 and/or the cutting member 7 deactivated with the connection 21:

$i_1$) with the useful metering of the feed spool run out, the winding of its end yarn continues right to the end, in other words up to its disappearance indicated by the sensor 4 of the yarn, measuring its length with the meter-counter of the winding station;

$i_2$) command of the normal spool-change with the connection 34 to the unit 16, taking away the empty spool and introducing the full spool 1 and lifting its new end of yarn 2, and joining it with the package-side end according to the standard reattachment process from a) to g). For the command of this normal reattachment process the unit 16' can again be used;

$i_3$) continuation of the winding, detecting with the meter-counter the reaching of a length of wound yarn equal to the sum of the lengths of the defective portions, at the start of the new spool and at the end of the empty spool. Once such a length value is reached the command of the cutting member of the yarn-clearer is carried out with the connection 31;

$i_4$) in place of step a) of the standard reattachment process, the command with the connection 32 of the capture of the end of the yarn from the side of the package 12 with the suction nozzle 10, commanding with the connection 33 the counter-rotation of the actuation roller 13 of the package detecting from its meter-counter that the package gives up a length of yarn corresponding to the sum of defective end portions, then cutting the portion of yarn given up.

At the end of such removal operations $i_1$–$i_4$ of the process steps described up to now, the unit 30 commands the same operations b)-g) of the normal reattachment cycle, already having the end available from the package side, or—in the same way as the case described previously—it passes the management thereof to the unit 16' which is made to function again by the unit 16, and instead disconnects the unit 30.

The process and the device described up to now with reference to FIG. 3 allow greater precision in the elimination of the desired length of the end portions.

A further variant embodiment of the present invention is illustrated with reference to FIGS. 6 and 7, which show the unwinding station of the spool or of the package for feeding the yarn, arranged in the lower part of the winding station. With reference to FIGS. 4 and 5, showing, for the spinning spool and for the dying package respectively, the positions of the defective or potentially defective portions of yarn, it is foreseen to install sensors, for example of the optical type, to detect that the unwinding of the layers of end yarn is taking place. Such a variant device is suitable when the length of the defective portion is substantial and occupies a significant part of the winding of the feed package.

FIG. 6 shows the unwinding station of the feed spool 1 with its critical start and end layers 40 and 41, respectively. A first sensor, for example an optical sensor 43 consisting of a source $43_S$ and a receiver $43_R$, is tangent to the tube and in correspondence with the start layer 40 to be unwound. From the start of the unwinding and until the winding part 40 intercepts the optical path of the light signal emitted by the source $43_S$ the defective or potentially defective yarn unwinds. When, on the other hand, the receiver $43_R$ starts to receive the light signal such a defective portion has ended. Alternatively, reflective sensors can also be used, equipped with the same emitter and receiver part of the light directed tangentially to the body explored and reflected from it.

From the start of the unwinding until the positive disappearance of the signal the metering wound and to be eliminated of the start winding portion is detected, for example with the outlined process with reference to FIG. 5. A second sensor, for example an optical sensor 53 consisting of a source $53_S$ and a receiver $53_R$, is aligned in correspondence with the end layer 41 to be unwound, tangentially to the tube of the spool. From the start of the unwinding, and until the body of the spool 1 intercepts the optical path of the light signal emitted by the source $53_S$, the yarn inside the package under the control of the yarn clearer 11 unwinds. When, on the other hand, the receiver $53_R$ starts to receive the light signal the defective end portion has begun. From the disappearance of the signal until the end of the unwinding the metering to be eliminated of the end winding portion is detected, for example still with the outlined elimination process with reference to FIG. 3 operating on the two start and end portions joined and wound on the package before unwinding them again and sucking them with the suction nozzle from the side of the package.

FIG. 7 shows the unwinding station of the feed dying package 1' with its critical start and end layers 40' and 41', respectively. A first optical sensor 43, totally analogous to the one used for the spool according to FIG. 6, is aligned tangentially to the outer start layer 40' to be unwound. From the start of the unwinding and until the winding part 40' intercepts the optical path of the light signal emitted by the source $43_S$ the defective or potentially defective yarn unwinds. When, on the other hand, the receiver $43_R$ starts to receive the light signal such a defective portion has ended. From the start of the unwinding until the positive disappearance of the signal the metering wound and to be eliminated of the start portion of the package 1' is detected, for example with the outlined process with reference to FIG. 5, together with that which shall be detected and measured for the end portion. A second optical sensor 53, consisting of a source $53_S$ and a receiver $53_R$, is aligned in correspondence with the end layer 41' wound on the perforated tube of the dying package, still tangential to the base perforated tube of the dying package. From the start of the unwinding and until the body of the package 1' intercepts the optical path of the light signal emitted by the source $53_S$ the yarn inside the package under the control of the yarn clearer 11 unwinds. When, on the other hand, the receiver $53_R$ starts to receive the light signal the defective end portion has begun. From the disappearance of the signal until the end of the unwinding the metering to be eliminated of the end portion of the winding is detected adding it to that of the start portion.

Alternatively, it is possible to use just the sensors 53 mentioned above only to detect the start of the unwinding of the end layer of the feed package which has run out, whereas the detection of the unwinding of the start portion of the new package is given by the change in feed itself as the start and thus detected by the meter counter itself of the winding station.

What is claimed is:

1. Process for the automatic elimination of start and finish end portions of yarn, containing frequent and widespread defects, from spools of feed yarn and packages of wound yarn, of winding units of an automatic winder comprising, using said automatic winder's members dedicated to reattachment operations of said end portions of yarn from said spools and packages, wherein at each change of a feed spool (1), said yarn has portions thereof removed, respectively said start and finish end portions of yarn of said feed spool and said package are sucked in using one or more suction nozzles (9, 10) for capturing and moving said end portions, said suction nozzles having preset times to capture a portion of yarn of a predetermined length, and carrying out said reattachment operation of said end portions of yarn, and prior to said reattachment operation having cut said start and finish end portions of yarn and sucking them in with said suction nozzles (9, 10), said automatic winder further comprising optical sensors (43, 53) aligned or directed tangentially to said feed spool (1) of yarn, and in correspondence with start layers (40, 40') and end layers (41, 41') of said spools of feed yarn to be unwound.

2. Process for the elimination of start and finish end portions of yarn fed to an automatic winder according to claim 1, wherein, prior to said reattachment process, said start end portion of said feed spool is eliminated by sucking it into said suction nozzle (9) for said pre-set time and a command to cutting member of yarn-clearer is carried out on said start end portion of yarn, and said finish end portion of said feed spool is wound to a package (12) and eliminated from said package (12) by sucking it into said suction nozzle (10) and releasing it from said package (12) through counter-rotation of said package's (12) actuation roller (13) so that said package (12) unwinds a length of yarn necessary for removal of its defective portion, and a command to cutting member of yarn-clearer is carried out on said finish end portion of yarn, and during removal intervention said automatic winder's yarn-clearer (11), and/or yarn cutting member (7), are deactivated.

3. Process for the elimination of start and finish end portions of yarn fed to an automatic winder according to claim 2, wherein said start and finish end portions of said feed spools and packages are eliminated together, with said yarn-clearer (11) and/or its cutting member (7) deactivated, by the following steps:

metering of said feed spool (1) of yarn and winding said yarn (2) until said finish end portion of yarn is wound to said package (12), changing said feed spool (1) joining yarn of said changed feed spool with said finish end portion of yarn on said package (12) according to said reattachment process, continuation of winding, detecting with a meter-counter of said automatic winder a length of wound yarn equal to the sum of the lengths of defective portions, at the start of said new feed spool and at the end of said new feed spool: once said length is reached a command of said cutting member (7) is initiated, capturing said finish end portion of yarn on said package (12) with said suction nozzle (10), with simultaneous counter-rotation of said package (12) detecting with said meter-counter a length of yarn corresponding to said sum of lengths of said defective portions, reattaching, end available from said (12) package, and sucking in its start and end portion with the suction nozzle (10).

4. Process for the elimination of start and finish end portions of yarn fed to an automatic winder according to claim 3, wherein said spools of feed yarn comprise critical layers (40, 41; 40', 41') containing defective start and finish end portions of yarn that are detected by a first sensor (43), which indicates that said defective start end portion of yarn is unwinding, and by a second sensor (53) which indicates a beginning of said defective end portion of yarn, thus detecting said start and finish end portions to be eliminated.

5. Process for the elimination of start and finish end portions of spools of yarn fed to an automatic winder according to claim 4, wherein said sensors (43, 53) comprise, respectively a source ($43_S$, $53_S$) and a receiver ($43_R$, $53_R$), aligned or directed tangentially to said spools of feed yarn (1), and in correspondence with start layers (40, 40') and end layers (41, 41') of said spools of yarn to be unwound.

6. Process for the elimination of start and finish end portions of yarn fed to an automatic winder according to claim 5, wherein said critical layers (40, 41; 40', 41') of said feed spools containing said defective start and finish end portions of yarn are detected by said meter-counter of said automatic winder starting from the change in said feed spool, which indicates that said defective start end portion of yarn is unwinding, and by a second sensor (53) which indicates the beginning of said defective end portion of yarn, thus detecting said start and finish end winding portions to be eliminated.

7. Device for the automatic elimination of start and finish end portions of yarn, containing frequent and widespread defects, from spools of feed yarn and packages of wound yarn, of winding units of an automatic winder, using the same members thereof dedicated to a reattachment operations of said ends, comprising a control unit (16) having another control unit (16') which controls and commands a reattachment process of said yarn being wound, and a control and management unit (20, 30), as an alternative to said unit (16') that controls and commands said reattachment process, which in turn commands and controls treatment of said yarn and oversees elimination of said start and finish end portions, said automatic winder further comprises optical sensors (43, 53) having a source ($43_S$, $53_S$) and a receiver ($43_R$, $53_R$), aligned or directed tangentially to spools of feed yarn (1), and in correspondence with start layers (40, 40') and end layers (41, 41') of said spools of feed yarn to be unwound.

8. Device for the elimination of the start and finish end portions of spools of yarn fed to an automatic winder according to claim 7, wherein said control and management unit (20) that controls and commands said reattachment process, and oversees the elimination of end portions is equipped with a connection (21) for deactivation of a yarn clearer (11) and/or yarn-cutting member (7), with a connection (22) for commanding a suction nozzle (9) from a side of said feed spool (1) and with a connection (23) for commanding a suction nozzle (10) from a side of a package (12) for their autonomous use capturing said start and finish ends outside of a reattachment cycle, and with a connection (24) for simultaneous command of counter-rotation of an actuation roller (13) of said package (12).

9. Device for the elimination of the start and finish end portions of spools of yarn fed to an automatic winder according to claim 8, wherein said unit (30) which oversees the elimination of said start and finish end portions is equipped with a connection (21) for deactivation of said yarn clearer (11) and/or cutting member (7), with a connection (34) to said control unit (16) for changing of spools and continuing winding, with a connection (32) for commanding, based upon indications of a meter-counter of said automatic winder, suction with said suction nozzle (10) of the sum of the lengths of a defective portions of yarn—start portions for a new spool and end portions of said new spool, until a length of wound yarn equal to the sum of the lengths of said defective portions is reached, with a connection (31) for the command of the cutting member (7) of said yarn clearer, and with a connection (33) for commanding counter-rotation of said actuation roller (13).

10. Device for the elimination of the start and finish end portions of spools of yarn fed to an automatic winder according to claim 9, wherein said unit (20, 30) which oversees elimination of said end portions is equipped with sensors (43, 53) for detecting end and start, respectively, of unwinding critical layers (40, 41) of said spools of yarn containing defective start and finish end portions.

* * * * *